US005565905A

United States Patent [19]

Kajiya et al.

[11] Patent Number: 5,565,905

[45] Date of Patent: Oct. 15, 1996

[54] THERMAL PRINTER APPARATUS

[75] Inventors: Hiroshi Kajiya, Tokyo; Sakae Takeuchi, Saitama-ken, both of Japan

[73] Assignee: Kabushiki Kaisha Sato, Japan

[21] Appl. No.: 406,555

[22] Filed: Mar. 20, 1995

[30] Foreign Application Priority Data

Mar. 25, 1994 [JP] Japan ..... 6-077802

[51] Int. Cl.[6] ..... B41J 15/04; B41J 15/06

[52] U.S. Cl. ..... 347/222; 347/197

[58] Field of Search ..... 400/619, 642, 400/647.1, 120.16; 347/197, 222; 346/145

[56] References Cited

U.S. PATENT DOCUMENTS 4,480,933 11/1984 Shibayama et al. ..... 347/220

FOREIGN PATENT DOCUMENTS 4-296569 10/1992 Japan ..... 347/222

*Primary Examiner*—Huan H. Tran

*Attorney, Agent, or Firm*—Ostrolenk, Faber, Gerb & Soffen, LLP

[57] ABSTRACT

A thermal printer that facilitates thermal print head replacement as well as paper setting and removal. One paper guide for the paper to be printed is fixed to the main frame. Another paper guide is attached by a spring link to the frame for the print head, so that they may rotate together. The other paper guide and the head frame together rotate open to provide access between the paper guides. The head frame is rotatable open further beyond the rotation of the other paper guide to provide access to the print head. A stop on the other paper guide engages the main frame to prevent the further opening rotation of the other paper guide.

7 Claims, 4 Drawing Sheets

THERMAL PRINTER APPARATUS

BACKGROUND OF THE INVENTION

The present invention relates to a thermal printer apparatus, and more particularly to a thermal printer apparatus having a pair of paper guide members to guide paper between a thermal print head and platen roller, in which the guide member on the thermal print head side is rotated in conjunction with the rotation of a thermal print head support frame to separate the guide member from the other guide member.

DESCRIPTION OF THE PRIOR ART

In this type of thermal printer apparatus the printing section is comprised of a thermal print head and a platen roller, and paper guide formed by an upper guide member and a lower guide member that guides the paper sheet being fed to the printing section. To enable the paper to be set into position in the printer, or removed from the printer when the paper jams, the apparatus is arranged so that the head frame to which the print head is attached can be rotated, which separates the print head from the platen roller and, as the upper guide member follows the movement of the head frame, also separates the upper guide member from the lower guide member.

The printing face of the print head consists of arrays of numerous heating elements that become worn after the extended periods of use, making it necessary to periodically replace the print head. However, while the above-described conventional thermal printer apparatus, head frame, is highly convenient for setting and removing the paper, the upper guide member is a hindrance when the print head is being replaced.

An object of the present invention is to provide a thermal printer apparatus that facilitates both paper setting or removal and thermal print head replacement.

SUMMARY OF THE INVENTION

This summary refers to the drawings accompanying the specification. This invention provides a thermal printer apparatus comprising a pair of paper guide members 26 that guide paper 18 to be printed between a thermal print head 12 and a platen roller 16. The guide member 40 on the thermal print head 12 side rotates with the rotation of a head frame 14 that supports the thermal print head 12, separating the guide member 40 from the other guide member 42.

The head frame 14 and guide member 40 are linked by springs 46 arranged therebetween so that the guide member 40 follows the rotation of the head frame 14, and stop mechanisms 36 and 52 are provided that stop the rotation of just the guide member 40 when the head frame 14 has been rotated to a prescribed angle.

In accordance with this invention, as the guide member 40 on the thermal print head 12 side is liked to the head frame 14 by the springs 46, the guide member 40 moves together with the head frame 14 when the head frame 14 is rotated to separate the thermal print head 12 from the platen roller 16, moving guide member 40 away from the other guide member 42. The head frame 14 is rotated until the guide member 40 is stopped by the stop mechanisms 36 and 52. The paper 18 is set in place or removed with the printer in this open position. The head frame 14 is open wider when the thermal print head 12 is to be replaced. However, as such further movement by the guide member 40 is prevented by the stop mechanisms 36 and 52, the springs 46 stretch, increasing the separation between the head frame 14 and the guide member 40 to facilitate the replacement of the thermal print head 12. Thus, it continues to be easy to set or remove paper 18, while the thermal print head 12 can be easily replaced without the guide member 40 getting in the way.

Other features and advantages of the present invention will become apparent from the following description of the invention which refers to the accompanying drawings.

BRIEF DESCRIPTION OF THE DRAWING(S)

DETAILED DESCRIPTION OF EMBODIMENTS OF THE INVENTION

The invention will now be described with reference to FIG. 1, which is a view showing the overall arrangement of the thermal printer apparatus of this invention, FIG. 2, which shows the printer with the head frame rotated away from the platen roller to replace the paper, and FIG. 3, which shows the principal parts in close-up.

Figure 1:
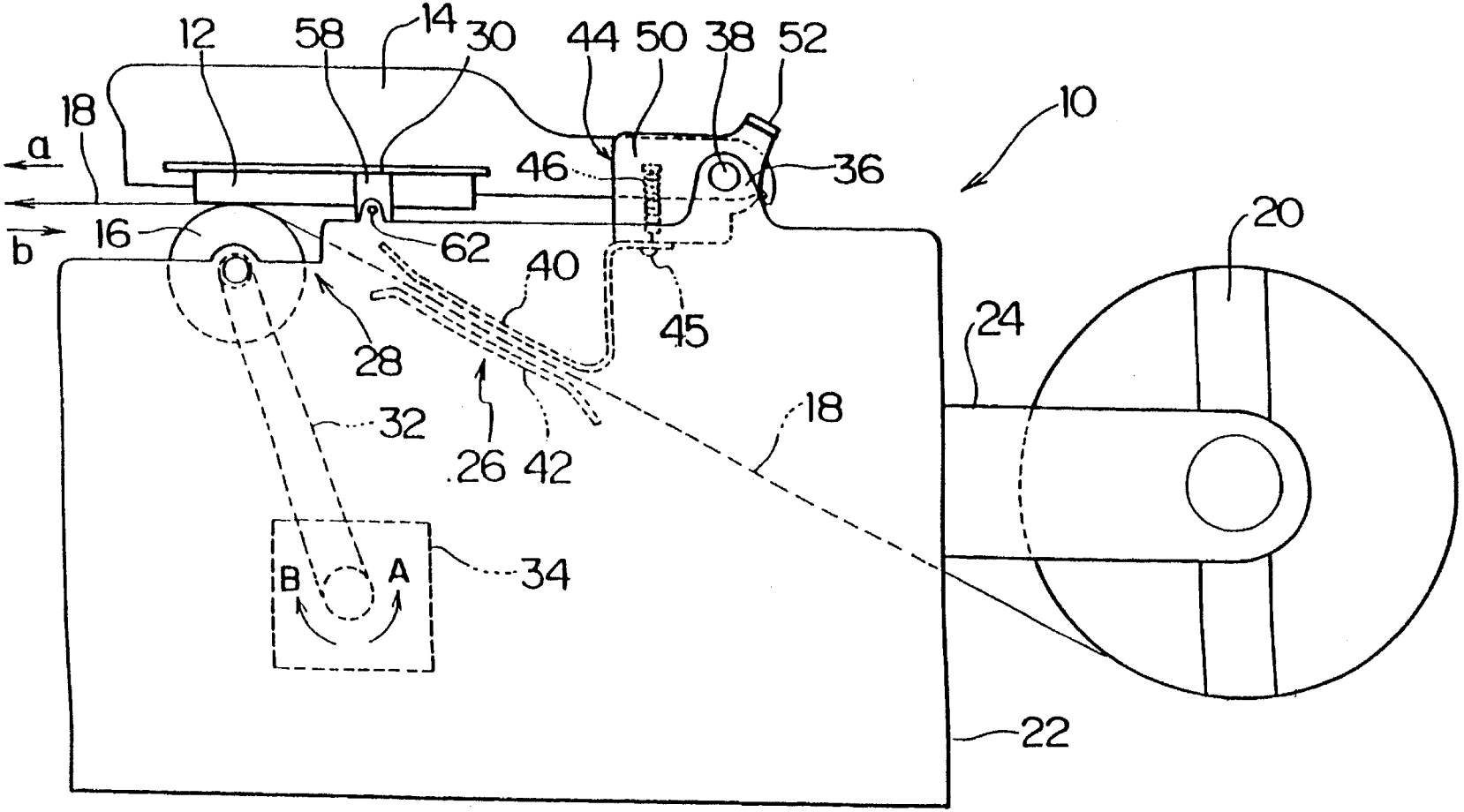
FIG. 1 is a general view of the thermal printer apparatus of this invention.

With reference to FIG. 1, a roll of paper 18 to be printed is fed from a reel 20 that is rotatably mounted at the end of an arm 24 that projects from the rear of the main printer frame 22 (that is, from the right, with respect to the drawing). Paper 18 from the reel 20 is guided by paper guide members 26 to a printing section 28 where the paper 18 is printed. The printing section 28 primarily comprises a platen roller 16 that is rotatably supported on the frame 22, and a thermal print head 12 supported by a head frame 14 via a head-holder 30. The thermal print head 12 is urged against the platen roller 16 by a pressure mechanism (not shown). A timing belt 32 couples the platen roller 16 by a pressure mechanism (not shown). A timing belt 32 couples the platen roller 16 to a stepping motor 34 that can operate in forward or reverse. When the stepping motor 34 is rotated in the direction indicated in the drawing by arrow A, the platen roller 16 is rotated by the rotational force transmitted by the timing belt 32, thereby transporting the paper 18 in the direction indicated by arrow a. When the stepping motor 34 is rotated in the direction indicated in the drawing by arrow B, the paper 18 is transported in the direction indicated by arrow b, that is, backwards.

The rear edge portion on the head frame 14 is pivotally mounted on a shaft 38 held by a pair of bearing lugs 36 that project upward from the main frame 22. The paper guide members 26 comprise an upper guide member 40 and a lower guide member 42 between which the paper 18 is guided. Screws 45 are used to affix the rear end of the upper guide member 40 to a guide frame 44 pivotally mounted on the shaft 38. The lower guide member 42 is affixed to the main frame 22. The guide frame 44 and head frame 14 are linked by two springs 46, one at each side. These springs 46 maintain the guide frame 44 and head frame 14 a set distance apart, except when the springs 46 are stretched or compressed by an external force. As a result, when the head frame 14 is rotated, the upper guide member 40 is also rotates in the same direction. Springs 46 are formed of spring metal, rubber or other such resilient material.

Figure 2:
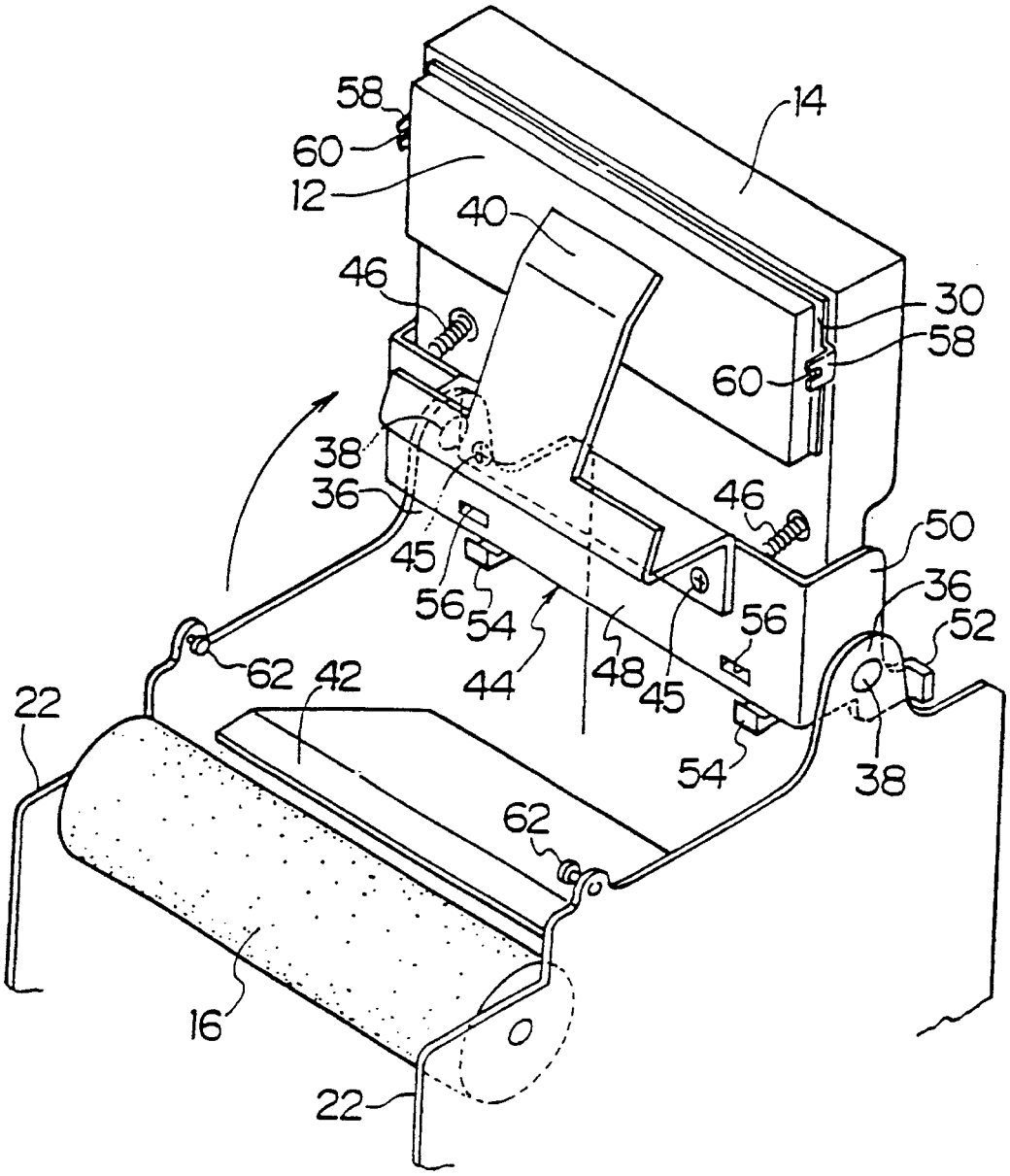
FIG. 2 is a perspective view of the principal parts, illustrating how the paper is loaded, with the head frame rotated away from the platen roller.
Figure 3:
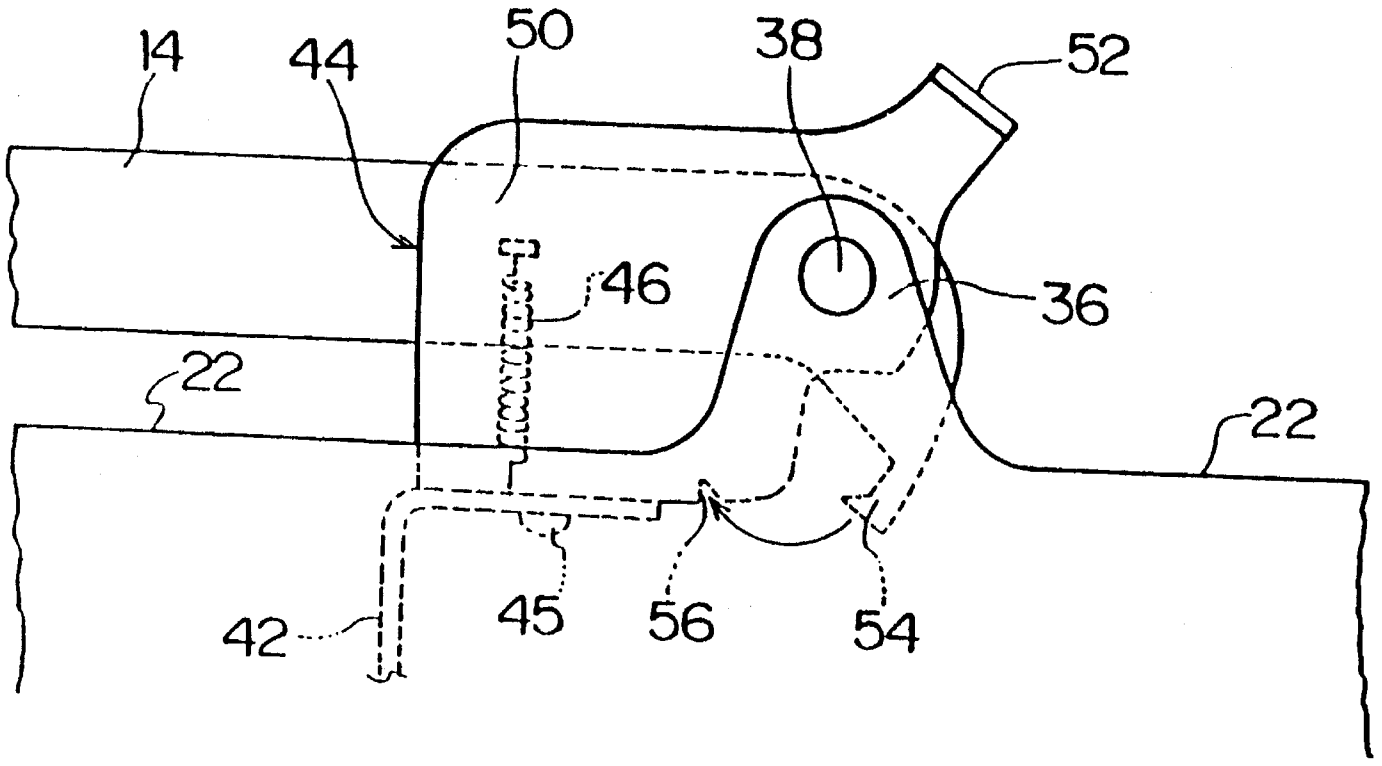
FIG. 3 is a close-up view of the principal parts of FIG. 1.

With reference to FIGS. 2 and 3, the guide frame 44 comprises a plate 48 that supports the upper guide member 40, and side plates 50 provided at each end of the support plate 48 perpendicularly to the support plate 48. The side plates 50 are supported on the shaft 38. The side plates 50 also have contact plates 52 that come into contact with the bearing lugs 36 when the upper guide member 40, in conjunction with the head frame 14, is rotated by about 90 degrees. A pair of engaging hooks 54 are formed on the rear edge of the head frame 14. When the guide frame 44 is fixed in place and the head frame 14 is pivoted away from the guide frame 44, and head frame 14 is turned against the resistance of the springs 46 and the hooks 54 engage with openings 56 formed on the lower edge of the support plate 48, thereby fixing the head frame 14.

Each end of the head-holder 30 has a prong-shaped portion 58, with the prongs pointing toward the main frame 22. The opening 60 between the prongs engages with pins 62 provided at corresponding positions on the main frame 22, thereby ensuring the correct positioning of the thermal print head 12 and platen roller 16. With the thermal print head 12 in contact with the platen roller 16, the head frame 14 is locked onto the main frame 22 by a locking mechanism (not shown).

The operation of the thermal printer apparatus 10 thus configured will now be described. For this description, it is assumed that the paper 18 has been loaded onto the reel 20. With the printer unlocked and the thermal print head 12 at the primary open position, as shown in FIG. 2, the thermal print head 12 is swivelled upward, away from the platen roller 16. As the head frame 14 and guide frame 44 are joined by springs 46, this also rotates the upper guide member 40 away from the lower guide member 42. The head frame 14 is rotated until the contact plates 52 abut the bearing lugs 36. The leading edge of the paper 18 is then drawn from the reel 20, passed along the upper surface of the lower guide member 42 and brought over the top of the platen roller 16. As the thermal print head 12 is separated from the platen roller 16 and the upper guide member 40 is separated from the lower guide member 42, it is easy to set the paper 18 in place. The head frame 14 is then pivoted down to bring the thermal print head 12 into contact with the platen roller 16 with the pins in engagement with the prong-shaped portions 58, thereby ensuring that the thermal print head 12 and platen roller 16 are correctly positioned. The upper guide member 40 and lower guide member 42 have also been brought close together, forming a guide passage for the paper 18. The head frame 14 is then locked onto the main frame 22, completing the setting of the paper 18.

Figure 4:
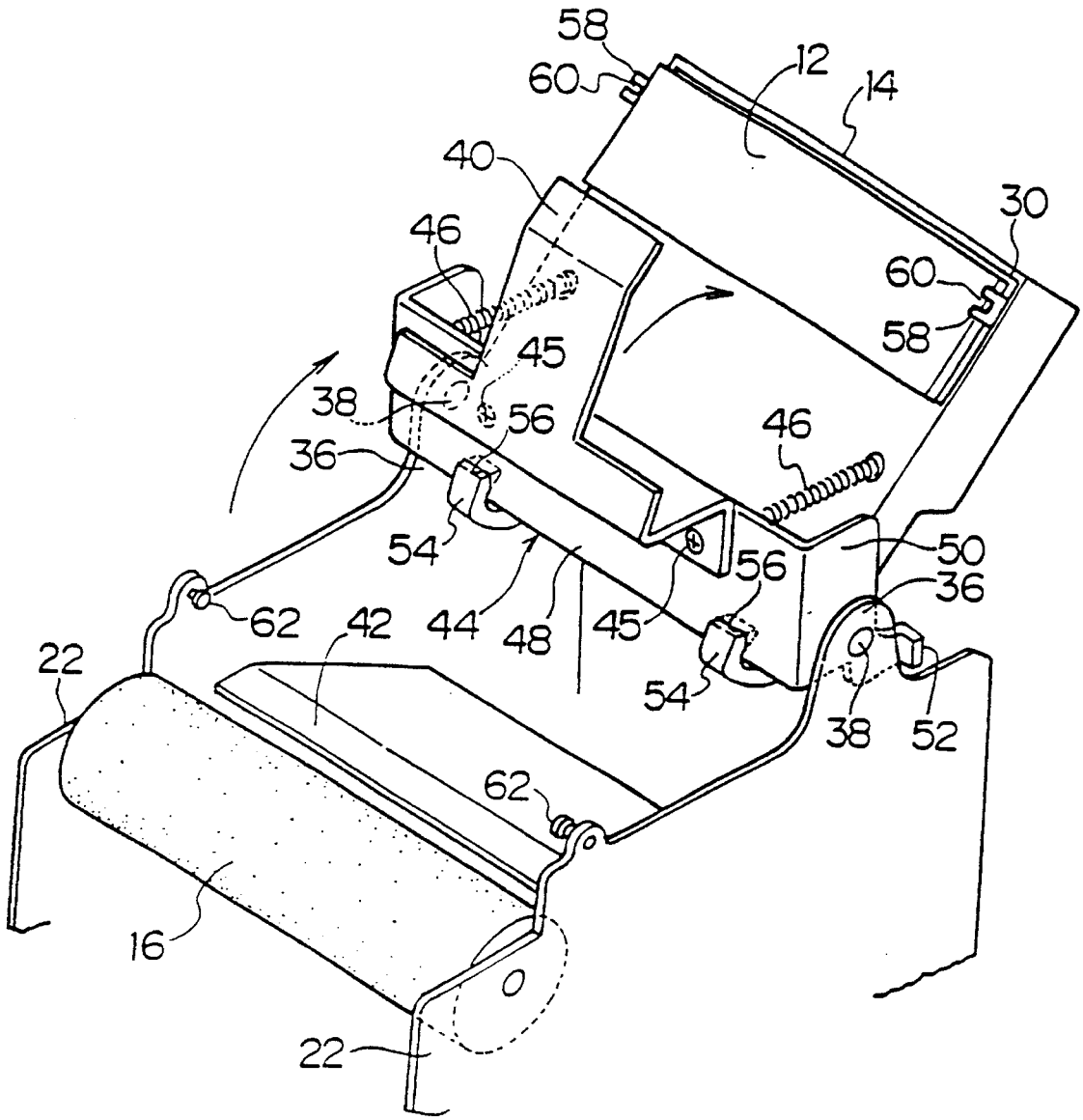
FIG. 4 is a perspective view illustrating the method of replacing the thermal print head.

The replacement of the thermal print head 12 will now be described. Head frame 14 (with the upper guide member 40) is rotated up until contact plates 52 abut the bearing lugs 36. Next, the head frame 14 is opened wider, to the secondary open position shown in FIG. 4, where the head frame 14 is held by the hooks 54 of the head frame 14 engaging with the openings 56 on the guide frame 44. With the contact plates 52 of the guide frame 44 abutting the bearing lugs 36, the further movement of the head frame 14 draws the head frame 14 away from the upper guide member 40, stretching the springs 46 that link the head frame 14 and the guide frame 44. The thermal print head 12 can now be replaced without the upper guide member 40 getting in the way. When the thermal print head 12 has been replaced, the hooks 54 are released from the openings 56 by pushing the upper guide member 40 slightly toward the platen roller 16. As a result the springs 46 contract, restoring the original spacing between head frame 14 and guide frame 44.

In the above thermal printer apparatus 10 the head frame 14 and upper guide member 40 are rotated together by means of the springs 46, and when the head frame 14 is rotated to a prescribed angle the rotation of the upper guide member 40 is stopped. Thus, the thermal print head 12 can be readily replaced without the upper guide member 40 getting in the way, while preserving the ease with which the paper 18 can be set and removed. Moreover, while the apparatus is arranged so that when the head frame 14 is swung upright the contact plates 52 abut against the bearing lugs 36 and thereby stop the rotation of just the guide frame 44, it is not limited to this relationship between the contact plates 52 and bearing lugs 36.

Thus, as described in the foregoing, in accordance with the thermal printer apparatus of this invention, spring means are used to link the head frame and a guide member so that the guide member rotates in conjunction with the rotation of the head frame, and a stop mechanism is provided that stops just the guide member when the head frame has been rotated to a certain angle. This facilitates the task of replacing the thermal print head, as the guide member is not in the way, and this is accomplished while maintaining the ease with which the paper can be set and removed.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A thermal printer comprising:

main frame; a fixed first paper guide member fixed on the main frame;

a thermal print head frame rotatably supported on the main frame; a thermal print head supported by the head frame and movable with the head frame;

a movable second paper guide member; a spring link joining the second paper guide member to the head frame; the head frame being so rotatably supported on the main frame as to be rotatable about an axis such that the second paper guide member is rotated away from the first paper guide member by the rotation of the head frame in one direction; and second paper guide member stop means for engaging the main frame to stop the rotation of the second paper guide member away from the first paper guide member when the head frame has been rotated in the one direction to a prescribed angle end wherein the spring link permits further rotation of the head frame in the one direction after the second paper guide member has been stopped.

2. The printer of claim 1, further comprising a platen positioned in opposition to the print head when the head frame has been moved in an opposite direction to an operating position for printing.

3. The printer of claim 2, further comprising a paper supply for delivering paper between the print head and the platen.

4. The printer of claim 3, further comprising moving means for moving the supplied paper past the print head.

5. The printer of claim 4, wherein the moving means comprises the platen, the platen being a roller which moves the paper by rolling with the paper on the platen roller, and means for rotating the platen roller.

6. The printer of claim 2, further comprising means for holding the head frame in the further rotated position in the one direction against urging of the spring link.

7. The printer of claim 6, wherein the print head is removably attached to the head frame.

* * * * *